US008342903B2

(12) United States Patent
O'Connor et al.

(10) Patent No.: US 8,342,903 B2
(45) Date of Patent: Jan. 1, 2013

(54) ADJUSTABLE TOY VEHICLE TRACK INTERSECTION ASSEMBLIES

(75) Inventors: Stacy O'Connor, Long Beach, CA (US); Michael Nuttall, South Pasadena, CA (US); Paul W. Schmid, Ojai, CA (US)

(73) Assignee: Mattel, Inc., El Segundo, CA (US)

( * ) Notice: Subject to any disclaimer, the term of this patent is extended or adjusted under 35 U.S.C. 154(b) by 332 days.

(21) Appl. No.: 12/767,675

(22) Filed: Apr. 26, 2010

(65) Prior Publication Data

US 2011/0101120 A1 May 5, 2011

Related U.S. Application Data

(60) Provisional application No. 61/172,620, filed on Apr. 24, 2009.

(51) Int. Cl.
*A63H 18/00* (2006.01)

(52) U.S. Cl. ..... 446/444; 238/10 A

(58) Field of Classification Search ..... 238/10 A, 238/10 E, 10 F; 104/54; 446/433, 444–447
See application file for complete search history.

(56) References Cited

U.S. PATENT DOCUMENTS

| | | | | |
|---|---|---|---|---|
| 1,551,002 | A | | 8/1925 | Beck |
| 1,715,891 | A | | 6/1929 | Beck |
| 3,204,574 | A | | 9/1965 | Frisbie et al. |
| 3,359,920 | A | | 12/1967 | Iammatteo |
| 3,469,340 | A | | 9/1969 | Breneman et al. |
| 3,559,335 | A | | 2/1971 | See et al. |
| 3,621,602 | A | | 11/1971 | Barc et al. |
| 3,633,902 | A | | 1/1972 | Worden |
| 3,636,651 | A | | 1/1972 | Hubiak et al. |
| 3,641,704 | A | | 2/1972 | Sims et al. |
| 3,708,116 | A | | 1/1973 | Woodward |
| 3,734,500 | A | * | 5/1973 | Cooper ..... 273/442 |
| 3,814,021 | A | | 6/1974 | McHenry |
| 3,858,875 | A | * | 1/1975 | Nemeth et al. ..... 273/460 |
| 4,091,561 | A | | 5/1978 | Kimura |
| 4,094,089 | A | * | 6/1978 | Sano ..... 446/487 |
| 4,140,276 | A | | 2/1979 | Halford |
| 4,185,409 | A | | 1/1980 | Cheng |
| 4,249,733 | A | | 2/1981 | Eddins et al. |
| 4,254,576 | A | | 3/1981 | Matsumoto et al. |
| 4,355,807 | A | | 10/1982 | Prehodka |

(Continued)

FOREIGN PATENT DOCUMENTS

| | | |
|---|---|---|
| EP | 0540530 | 5/1993 |

(Continued)

*Primary Examiner* — Jason C Smith
(74) *Attorney, Agent, or Firm* — Kolisch Hartwell, PC

(57) ABSTRACT

Intersection apparatus for use with tracks for toy vehicles define a first toy vehicle pathway from a ramp portion and across the gap to a corresponding receiving portion, and a second toy vehicle pathway that crosses the first. The ramp portion is translatable in a direction transverse to the pathways between a bypass position in which the trajectory of a toy vehicle traversing the first pathway passes and does not intersect that of a toy vehicle traversing the second, and an intersect position in which the trajectories intersect. The ramp portion may further be translatable to a second bypass position defining a trajectory passing on the opposite side of the second vehicle's trajectory relative to the trajectory defined when the ramp portion is in the first bypass position. When the ramp is in the intersect position, toy vehicles traversing the pathways at substantially the same time will collide.

17 Claims, 3 Drawing Sheets

U.S. PATENT DOCUMENTS

| | | | | |
|---|---|---|---|---|
| 4,383,688 | A | 5/1983 | Prehodka | |
| 4,425,735 | A | 1/1984 | Kulesza et al. | |
| 4,513,966 | A * | 4/1985 | Mucaro et al. | 238/10 F |
| 4,513,967 | A | 4/1985 | Halford et al. | |
| 4,519,789 | A | 5/1985 | Halford et al. | |
| 4,558,867 | A | 12/1985 | Hippely | |
| 4,605,230 | A * | 8/1986 | Halford et al. | 273/129 AP |
| 4,715,843 | A | 12/1987 | Ostendorff et al. | |
| D305,676 | S | 1/1990 | Ngai | |
| 5,038,685 | A | 8/1991 | Yoneda et al. | |
| 5,052,972 | A | 10/1991 | Suimon et al. | |
| 5,102,133 | A | 4/1992 | Chilton et al. | |
| 5,165,347 | A | 11/1992 | Wagner | |
| 5,174,569 | A | 12/1992 | Ngai | |
| 5,205,554 | A | 4/1993 | Copson | |
| 5,234,216 | A * | 8/1993 | Ostendorff | 273/127 A |
| 5,254,030 | A | 10/1993 | Ostendorff et al. | |
| 5,299,969 | A | 4/1994 | Zaruba | |
| 5,402,730 | A | 4/1995 | Salter et al. | |
| 5,433,641 | A | 7/1995 | Rudell et al. | |
| 5,542,668 | A | 8/1996 | Casale et al. | |
| 5,890,948 | A | 4/1999 | Nilsson | |
| 5,899,789 | A | 5/1999 | Rehkemper et al. | |
| 6,000,992 | A | 12/1999 | Lambert | |
| 6,062,942 | A | 5/2000 | Ogihara | |
| 6,089,951 | A | 7/2000 | Ostendorff | |
| 6,170,754 | B1 | 1/2001 | Halford | |
| 6,216,600 | B1 | 4/2001 | Verret | |
| 6,241,573 | B1 | 6/2001 | Ostendorff et al. | |
| 6,435,929 | B1 | 8/2002 | Halford | |
| 6,478,654 | B1 * | 11/2002 | Rehkemper et al. | 446/431 |
| 6,676,480 | B2 * | 1/2004 | Sheltman | 446/429 |
| 6,695,675 | B1 | 2/2004 | Ngan | |
| 6,793,554 | B1 | 9/2004 | Newbold | |
| 6,913,508 | B2 | 7/2005 | Hornsby et al. | |
| 6,951,497 | B1 * | 10/2005 | Ngan | 446/444 |
| D542,876 | S | 5/2007 | Laurienzo et al. | |
| 7,261,614 | B2 | 8/2007 | Laurienzo et al. | |
| 7,549,906 | B2 * | 6/2009 | Bedford et al. | 446/444 |
| 7,901,266 | B2 * | 3/2011 | Ostendorff | 446/429 |
| 2005/0287915 | A1 * | 12/2005 | Sheltman et al. | 446/444 |
| 2005/0287916 | A1 * | 12/2005 | Sheltman et al. | 446/444 |
| 2005/0287919 | A1 * | 12/2005 | Sheltman et al. | 446/444 |
| 2007/0049160 | A1 | 3/2007 | Matthes et al. | |
| 2007/0293122 | A1 | 12/2007 | O'Connor et al. | |
| 2007/0293123 | A1 | 12/2007 | Nuttall et al. | |
| 2008/0020675 | A1 * | 1/2008 | Ostendorff | 446/429 |
| 2008/0242193 | A1 | 10/2008 | Filoseta et al. | |
| 2008/0265048 | A1 | 10/2008 | O'Connor | |
| 2008/0268743 | A1 | 10/2008 | O'Connor et al. | |
| 2011/0101120 | A1 * | 5/2011 | O'Connor et al. | 238/10 A |

FOREIGN PATENT DOCUMENTS

| | | |
|---|---|---|
| EP | 1251917 | 8/2005 |
| GB | 2251193 | 7/1992 |
| GB | 2252736 | 8/1992 |
| JP | 03047286 | 2/1991 |
| WO | 9201497 | 2/1992 |
| WO | 0158556 | 8/2001 |
| WO | 2007131205 | 11/2007 |
| WO | 2007131207 | 11/2007 |

* cited by examiner

ADJUSTABLE TOY VEHICLE TRACK INTERSECTION ASSEMBLIES

RELATED APPLICATION

This application claims priority under 35 U.S.C. §119(e) to U.S. Provisional Patent Application Ser. No. 61/172,620, which was filed on Apr. 24, 2009 and is entitled "TOY TRACK WITH RAMP ADJUSTMENT MECHANISM". The complete disclosure of the above-identified patent application is hereby incorporated by reference for all purposes.

FIELD OF THE DISCLOSURE

The present disclosure is directed to toy vehicle tracks, and more particularly to toy vehicle tracks that incorporate intersections at which the pathway formed by the toy vehicle track crosses over itself, such as in a figure-8 track formation. The intersection assemblies described in the present disclosure incorporate adjustable components to allow a user to allow toy vehicles traversing the crossing pathways of the intersection to either collide with each other, or to bypass each other, for example at different elevations.

BACKGROUND

Toy tracks for toy vehicles such as toy cars may be used to set up play race courses and other play settings for the toy vehicles, to provide entertainment and challenges to players. In a simulated race course setting, the toy tracks are often set up in a looped course for the toy vehicles to circumnavigate. Typically, some sort of electrical or mechanical means is used to provide a motive force for the vehicles. For example, many tracks employ a pair of rotating, opposed bumpers between which the toy vehicles pass and are accelerated by the bumpers' rotation. An example of one configuration of such an assembly can be found in U.S. Pat. No. 6,793,554. Other examples of propulsion mechanisms, sometimes referred to as "boosters," may be found in the following patents and publications: U.S. Pat. No. 5,052,972, U.S. Pat. No. 5,165,347, U.S. Pat. No. 5,299,969, U.S. Pat. No. 5,402,730, U.S. Pat. No. 5,899,789, U.S. Pat. No. 6,241,573, US20080242193. Such track setups provide for the players to race cars against one another, either directly or successively, and to watch the cars as they travel along the course and perform stunts and crash.

The track pathway in play race course settings usually provides a generally flat surface disposed between an opposing pair of side rails, so that the toy vehicles are more or less constrained to traverse the guided pathway as they move. The track forming the pathway may be formed as a single unitary piece, but is often provided as a series of interconnectable segments. In either case, the pathway configurations in race course settings may vary quite a bit, such as to provide a number of different turns, twists, jumps, and so forth, along the pathway, either by means of specially-shaped track pieces, and/or by other structure coupled or incorporated into the track, such as ramps, inclines, and so forth.

Optionally, a pathway configuration may provide an opportunity for players to collide (or a challenge for players to avoid colliding) the toy vehicles traversing the track with one or more obstacles, and/or with each other. By incorporating an intersection in which the pathway crosses over itself, such as in a classic Figure-8 formation, for example, players may find excitement in attempting to crash (or avoid crashing) toy vehicles into each other as they enter into and cross through the intersection. Such collisions may result in one (or more) toy vehicles being propelled from the pathway, especially if one or more of the vehicles are moving with a fair amount of speed.

Some examples of toy vehicle tracksets incorporating intersecting pathways may be found in U.S. Pat. No. 3,734,500, U.S. Pat. No. 4,513,966, U.S. Pat. No. 4,519,789, U.S. Pat. No. 5,899,789, U.S. Pat. No. 6,062,942, U.S. Pat. No. 6,478,654, U.S. Pat. No. 6,913,508, US20070293122 and US20080020675. Some examples of toy vehicle tracksets with adjustable ramps and components can be found in U.S. Pat. No. 3,204,574, U.S. Pat. No. 3,814,021, U.S. Pat. No. 3,858,875, U.S. Pat. No. 4,094,089, U.S. Pat. No. 5,234,216, U.S. Pat. No. 6,676,480, and U.S. Pat. No. 6,951,497. The disclosures of all of these and all other references cited in this disclosure are incorporated herein by reference for all purposes.

SUMMARY

In the described embodiments, an intersection assembly for use with a toy vehicle track provides at least two toy vehicle pathways that cross each other at a transverse angle. One or both toy vehicle pathways may include a jump assembly having a ramp portion adapted to launch a toy vehicle over a gap and toward a corresponding receiving portion that is spaced therefrom. Optionally, some embodiments may include a first toy vehicle pathway with a jump assembly, and a second toy vehicle pathway consisting of a flat portion of track.

In the described embodiments, one (or both) of the jump assemblies, or at least the ramp portion(s) thereof, is movable between one or more positions in which the trajectory of a toy vehicle traversing one toy vehicle pathway does not intersect the trajectory of a toy vehicle traversing the other pathway, and one or more positions in which the toy vehicle trajectories intersect. In an "intersect" position, toy vehicles traversing the two toy vehicle pathways at substantially the same time will collide. As such, a user may use the intersection assembly to crash, or avoid crashing, toy vehicles traversing the toy vehicle track.

The intersection assemblies, their components, and operation, may be understood more readily after a consideration of the drawings and the Detailed Description.

DETAILED DESCRIPTION

Figure 1:
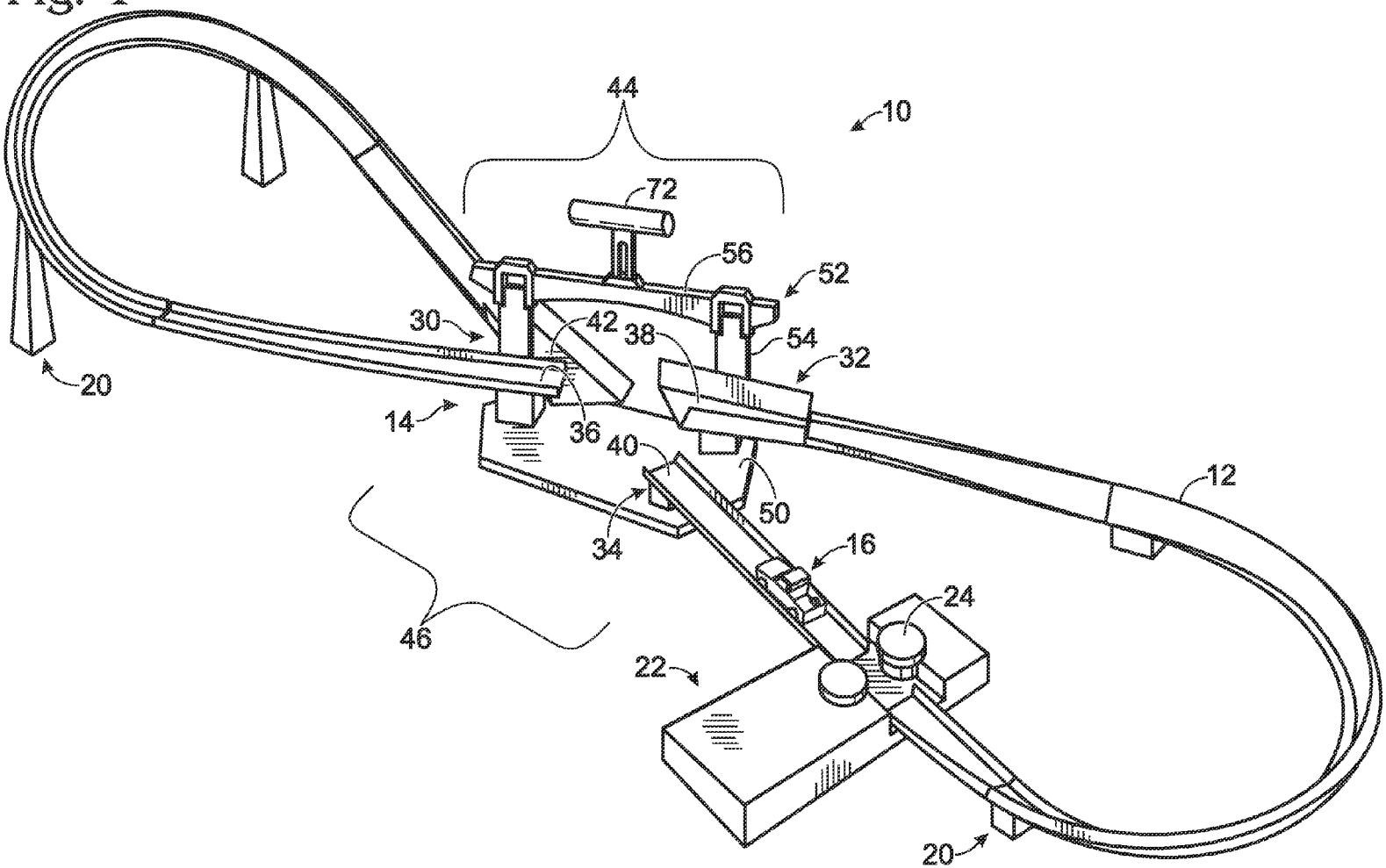
FIG. 1 is a perspective view of a toy vehicle track set including a momentum-providing accessory and incorporating an illustrative embodiment of an intersection assembly according to the present disclosure. The intersection assembly is shown to include a stationary jump assembly supported on a base, and a movable jump assembly supported on a framework extending from the base.

FIG. 1 shows a toy vehicle track set, indicated generally at 10, which includes a track 12 arranged in a figure-8 formation and including an intersection 14, suitable for use with one or more toy vehicles 16. Track set 10 is shown to include various accessory components, such as a number of track supports 20 disposed along the track 12, for example to provide stability to the track, to hold a section of track at a desired bias, to maintain the track in a particular configuration, and so forth. Track set 10 is also shown to include a momentum-providing accessory, or "booster" 22 configured to impart a motive force in a particular direction to toy vehicles passing through it, such as via opposing bumpers 24, which are driven to rotate at a rate suitable to provide passing toy vehicles with a desired velocity. Booster 22 may be powered in various manners, such as by batteries or via an AC power outlet. In the illustrated track set, booster 22 may provide sufficient momentum to propel a toy vehicle, such as toy vehicle 16, around the track for as long as the booster is powered.

To further a racing theme, track sets consistent with this disclosure may optionally incorporate additional components and/or decor consistent with the theme. Optionally, track sets may include some, or no accessory components, and/or different accessory components than those described herein. Moreover, track sets incorporating one or more intersections may take other configurations than as shown, and thus may include more than one intersection assembly.

As seen in FIG. 1, an intersection assembly, generally designated at 30, is situated at the intersection 14 of the pathway formed by the track 12. In the illustrated embodiments, intersection assembly 30 is a separable component that may be selectively attached to (and detached from) various track pieces in order to form a desired track configuration, such as the figure-8 configuration shown.

Intersection assembly 30 includes a first toy vehicle pathway 32 and a second toy vehicle pathway 34, which crosses the first pathway 32 at a transverse angle. In the illustrated embodiment, first pathway 32 is defined by ramp members 36, 38, also referred to herein as a ramp portion and a receiving portion, respectively. Ramp members 36, 38 are spaced to form a gap therebetween, and as such, the ramp portion (36) is adapted to launch a toy vehicle across the gap and toward the receiving portion (38).

Second pathway 34 of the illustrative embodiment shown in FIG. 1 is similarly defined by a pair of spaced ramp members 40, 42 across a gap. Ramp members 40, 42 are also referred to herein as a ramp portion and a receiving portion, respectively, with ramp portion (40) being adapted to launch a toy vehicle across the gap and toward the receiving portion (42).

For clarity, the ramp members defining the first pathway are referred to as first ramp portion 36 and first receiving portion 38, and the ramp members defining the second pathway are referred to herein as second ramp portion 40 and second receiving portion 42. Additionally, each corresponding pair of ramp members may be thought of as a jump assembly, such that first ramp portion 36 and first receiving portion 38 collectively form a first jump assembly 44, and second ramp portion 40 and second receiving portion 42 collectively form a second jump assembly 46.

The trajectories of toy vehicles traversing the jump assemblies may vary somewhat, for example due to different vehicle shapes and sizes, and may even differ with the same toy vehicle, for example due to variations in vehicle velocity, angle of departure from the ramp portion, and so forth. Receiving portions 38 and 42 are each shown to have a wider opening and higher side walls as compared with ramp portions 36 and 40, such as to ensure that a toy vehicle launched from a ramp portion will be "caught" by the corresponding receiving portion. Optionally, one or both of the receiving portions may be disposed at a slightly lower elevation as compared with their corresponding ramp portions.

Although the illustrated intersection assembly 30 is shown to include two jump assemblies, both including gaps that "overlap" with each other, other embodiments consistent with this disclosure may include more or fewer than two jump assemblies. For example, an alternate embodiment of an intersection assembly may include only one jump assembly, such that a first toy vehicle pathway through an intersection is defined by the jump assembly, whereas a second toy vehicle pathway through the intersection may consist of a flat portion of track, with the first and second pathways disposed so that a vehicle passing through the jump assembly may jump over the flat portion of track.

In either case, the trajectories of toy vehicles traversing the first and second pathways of the intersection may intersect, or bypass by each other without intersecting, depending on how one pathway is positioned relative to the other.

With reference to FIGS. 1-4, in the illustrated embodiment, intersection assembly 30 is shown to include a base 50, and a framework 52 extending from the base. Framework 52 is formed by a pair of upright supports 54, with the top portions thereof connected by a generally horizontal support 56.

The second jump assembly is supported on the base 50, and the first jump assembly is movably supported on the framework 52. More specifically, second ramp portion 40 and second receiving portion 42 are supported on base 50 via respective track supports 20. However, first ramp portion 36 and first receiving portion 38 are slidably mounted to the upright supports, respectively.

As such, the first jump assembly 44 is movable relative to the second jump assembly 46 via translation in a direction that is transverse to the first and second toy vehicle pathways. More particularly, in the illustrated embodiment, the movement is along a substantially vertical axis, so that the trajectory of a toy vehicle passing therethrough may be elevationally adjusted relative to that of a toy vehicle passing through the second jump assembly. As explained in detail below, this feature may allow a user of the track set 10 to determine whether the trajectories of toy vehicles traversing the jump assemblies 44, 46 may intersect or bypass each other, and thereby control whether two toy vehicles, each traversing one of the jump assemblies at substantially the same time, will collide with each other or not.

Figure 2:
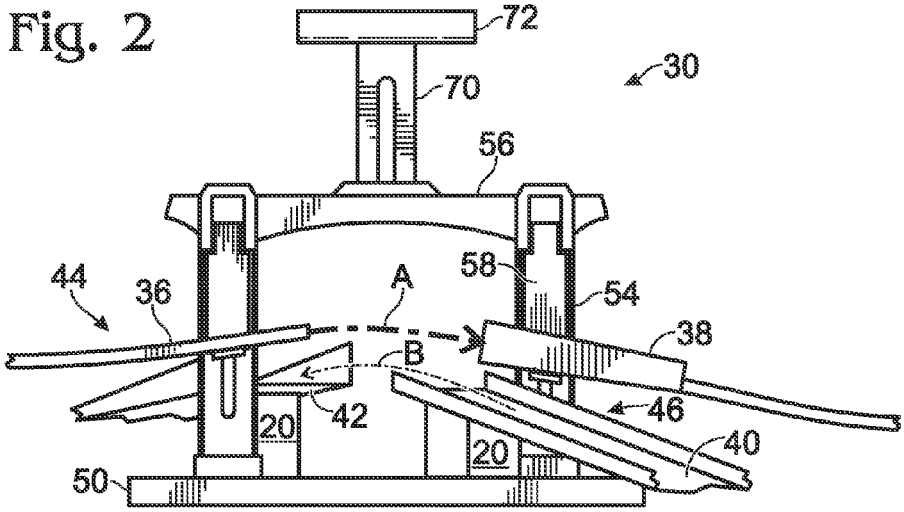
FIG. 2 is an elevation view of the front side of the intersection assembly of FIG. 1, with the movable jump assembly in a bypass position with respect to the stationary jump assembly.
Figure 3:
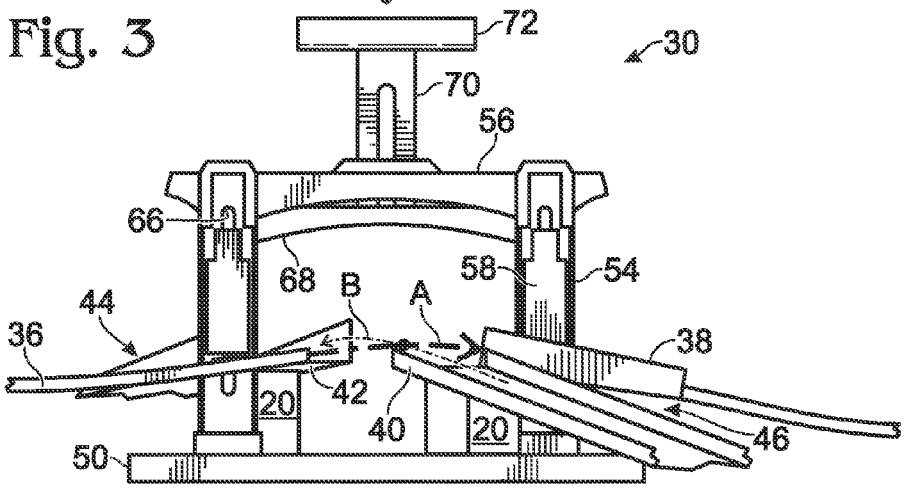
FIG. 3 is another elevation view of the front side of the intersection assembly of FIG. 1, with the movable jump assembly in an intersect position with respect to the stationary jump assembly.
Figure 4:
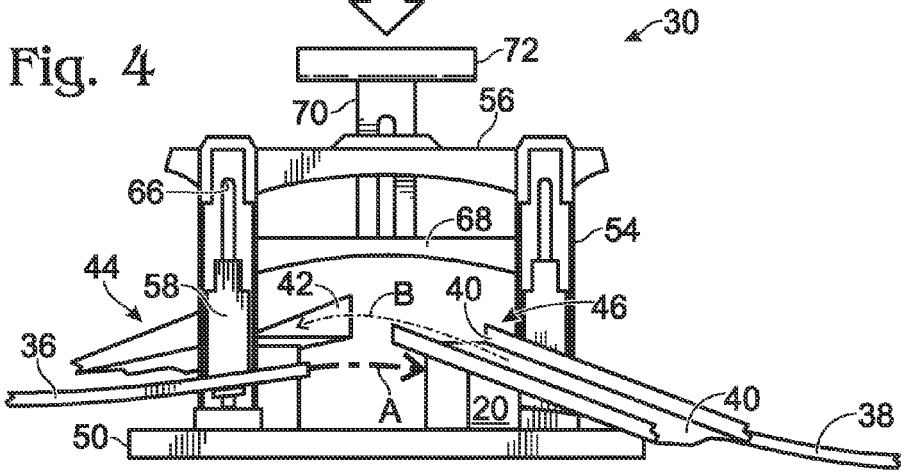
FIG. 4 is another elevation view of the front side of the intersection assembly of FIG. 1, with the movable jump assembly in a second bypass position with respect to the stationary jump assembly.

In FIGS. 2-4, arrow A represents the trajectory of a toy vehicle traversing first jump assembly 44, or, in other words, the trajectory of a toy vehicle launched from first ramp portion 36 over the gap and toward first receiving portion 38. Similarly, arrow B represents the trajectory of a toy vehicle traversing second jump assembly 46 (or the trajectory of a toy vehicle launched from second ramp portion 40 over the gap and toward first receiving portion 42). As shown, first jump assembly 44 is translatable between first position in which the trajectory of a toy vehicle traversing the first pathway passes above the trajectory of a toy vehicle traversing the second pathway, and a second position, in which the trajectory of a toy vehicle traversing the first pathway passes beneath the trajectory of a toy vehicle traversing the second pathway, through an intermediate position in which the first and second toy vehicle trajectories intersect.

More specifically, in FIG. 2, the first jump assembly 44 is shown to be in an upper position in which arrow A passes over, and does not intersect, arrow B. Accordingly, if two toy vehicles traverse the two jump assemblies in the relative positions shown in FIG. 2 at substantially the same time, the toy vehicle traversing the first jump assembly will pass over, and will not collide with, the toy vehicle traversing the second jump assembly. As such, this position may be referred to as a "bypass" position.

In FIG. 3, the jump assembly 44 is shown to be in an intermediate position, in which arrow A intersects arrow B. If two toy vehicles traverse the two jump assemblies in the relative positions shown in FIG. 3 at substantially the same time, they will collide. More specifically, in the illustrated embodiment, the collision will take place as both toy vehicles simultaneously jump the respective gaps in the jump assemblies. Correspondingly, this position may be referred to as an "intersect" position.

In FIG. 4, the jump assembly 44 is shown to be in a lower position, in which arrow A passes beneath, and does not intersect, arrow B. Two toy vehicles traversing the jump assemblies in these relative positions will not collide, and as such, this position may be referred to as another "bypass" position.

Thus, in the illustrated embodiment, the first jump assembly is movable between a first (or upper) bypass position, in which the first toy vehicle trajectory passes above the second toy vehicle trajectory, and a second (or lower) bypass position, in which the first toy vehicle trajectory passes beneath the second toy vehicle trajectory, through an intermediate position in which the first and second toy vehicle trajectories intersect.

Of course, the arrows A and B are simplified representations of the trajectories of toy vehicles traversing the jump assemblies, shown for the sake of convenience and ease of explanation. The actual trajectories of toy vehicles traversing the jump assemblies are defined by the volumes of space through which the toy vehicles pass. Also, even though the track set may be designed for use with a specific scale of toy vehicle, such as 1/64 toy vehicles, such toy vehicles vary somewhat in size and shape, and thus may define different trajectories. Thus, the "intersect" position of the jump assembly shown in FIG. 3 may represent one of a continuous range of intermediate positions.

Figure 5:
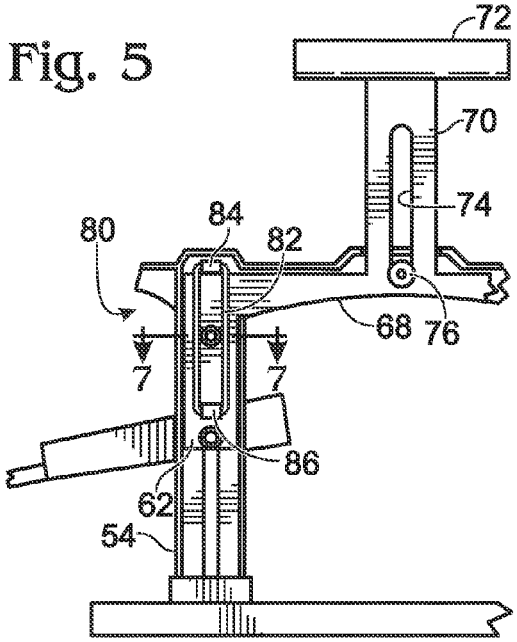
FIG. 5 is a partial elevation view of the rear side of the intersection assembly of FIG. 1, showing a biasing mechanism that urges the movable jump assembly into the bypass position shown in FIG. 2.
Figure 6:
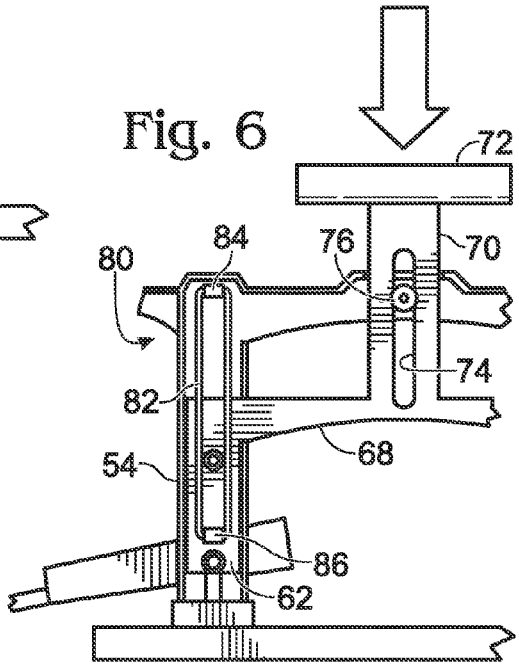
FIG. 6 is another partial elevation view of the rear side of the intersection assembly of FIG. 1, showing the biasing mechanism when the movable jump assembly is in the bypass position shown in FIG. 4.
Figure 7:
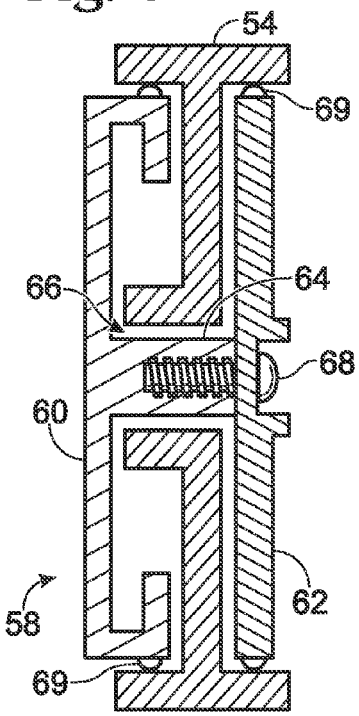
FIG. 7 is a cross-sectional view taken along the line 7-7 in FIG. 5.

The mounting of the first ramp portion 36 and first receiving portion 38 to the upright supports is described with additional reference to FIGS. 5-7, in which the ramp members are shown to be secured, respectively, to one of two sliding supports 58. As can be seen in FIG. 7, each sliding support 58 is shown to be composed of a front member 60 and a back member 62, coupled together via one or more shafts 64 that extend through a channel 66, which runs along a portion of each upright support 54. Fastener 68 securely fastens to front member 60 to back member 62 through shaft 64. However, any suitable coupling may be employed. Optionally, the sliding supports may be fabricated as unitary structures rather than composite.

First ramp portion 36 and first receiving portion 38 may be mounted to the sliding supports by any suitable method. For example, the portions may be welded, molded, or otherwise attached to the sliding supports, or secured mechanically, such as by means of one or more fasteners. Optionally, one or both sliding supports may include a bracing or connecting member to which the ramp and receiving portions may be detachably mounted.

In the illustrated embodiment, the sliding supports are configured to move relative to the corresponding upright supports in a range of movement between an upper position that corresponds to the first position of the first jump assembly, and a lower position that corresponds to the second position of the first jump assembly. More specifically, in the illustrated embodiment, channels 66 define the range and axis of movement between the extreme upper and lower positions of sliding supports 58. As such, the range and direction of movement of one of the jump assemblies relative to the other may be varied, such as among different embodiments, if a different framework configuration is incorporated, for example a framework that defines a non-vertical range of movement. In such embodiments, it may not be accurate to refer to non-intersecting pathways as passing "above" or "below" each other; rather, the framework of such intersection assemblies may be configured such that a first toy vehicle pathway may be translated from a first bypass position, in which the trajectory of a toy vehicle traversing the first toy vehicle pathway passes on one side of the trajectory of a toy vehicle traversing a second toy vehicle pathway, to a second bypass position, in which the trajectory of a toy vehicle traversing the first toy vehicle pathway passes on the opposite side of that of a toy vehicle traversing the second toy vehicle pathway.

In the illustrated embodiment, the sliding supports are movably coupled to, and sized relative to, upright support 54 to permit continuous slidable movement of one relative to the other, permitting continuous translation of the first ramp portion 36 and first receiving portion 38. Thus, FIG. 2 shows the first jump assembly 44 (and corresponding structure, such first ramp portion 36, first receiving portion 38, sliding supports 58, cross-piece 68, handle 72, and so forth), in the extreme upper position in the range of movement defined by channels 66. Similarly, FIG. 4 shows the first jump assembly (and corresponding structure) in the extreme lower position of the range.

To facilitate sliding movement, the supports and other components of the framework may be fabricated from a rigid, smooth material, such as a suitable plastic, such as to minimize interference from friction. Additionally, with reference to FIG. 7, front and back members 60, 62 are each shown to include sets of opposing nubs or bearings 69, which function to keep the sliding portions 58 centered relative to upright supports 54, while minimizing friction between the supports during sliding movement. Other embodiments may incorporate configurations in which the range of movement may be determined or otherwise defined by different components. Of course, other embodiments may include components that define a number of predetermined relative positions of one jump assembly relative to the other, such as by means of a series of stops in the range of movement.

For example, an alternative embodiment may include an intersect position in which the toy vehicle trajectories are slightly offset from (or partially overlap) one another, such as to cause toy vehicles traversing the pathways at substantially the same time in a certain manner. One such intersect position may be one in which the lower portion of a toy vehicle traversing the first pathway collides with the top portion of a vehicle simultaneously traversing the second pathway.

Moreover, although not required to all embodiments, in the illustrated embodiment, the sliding supports 58 are mechanically and rigidly coupled for cooperative, corresponding translation, by means of a cross-piece 68 joining the top portions of the back members of the sliding portions. As such, the ramp members of the movable jump assembly are moved as a unit. In other embodiments, the sliding supports and/or ramp members may be configured for independent movement relative to each other, and still other embodiments may include a configuration in which only one of the ramp or receiving portions of one or more jump assemblies is movable, such as a jump assembly that includes a movable ramp portion that moves relative to a corresponding, stationary receiving portion.

As shown most clearly in FIGS. 3-6, a handle support 70 extends upward from cross-piece 68, terminating in a handle 72, which is operable to move the first jump assembly between the first and second positions. Somewhat similar to upright supports 54, handle support 70 also features a central, vertical channel 74. A guide shaft 76 extends from the back surface of horizontal support 56, through vertical channel 74, and terminates in an oversized head; this arrangement may provide stability to the movable structure and ensure corresponding movement of the slidable supports along (or restrict movement of the supports other than in) the direction described by channels 66 and 74.

In use, that is, when the intersection assembly 30 forms a part of a track 12 that a toy vehicle 16 is traversing, the toy vehicle, upon entering the intersection assembly in either toy vehicle pathway will jump the gap, if its velocity is sufficient to carry it from the ramp portion across the gap to the receiving portion, whereupon the toy vehicle will exit the intersection assembly and proceed along the track. In a closed-loop track arrangement such as the figure-8 configuration shown in FIG. 1, the toy vehicle will then return to the intersection assembly and traverse the other toy vehicle pathway through the intersection, and so on.

If multiple vehicles are simultaneously traversing track 12, their relative speeds and/or the timing at which they are placed or launched onto the track may result in two vehicles simultaneously entering the intersection assembly, one on the first toy vehicle pathway and one on the second.

The operation of the intersection assembly shown in the illustrated embodiment is as follows: by moving handle 72 upward or downward, a user may change the trajectory of a toy vehicle traversing the first jump assembly 44 relative to that of a toy vehicle traversing the second jump assembly 46, such as by moving jump assembly from the upper bypass position shown in FIG. 2, through the intersect position shown in FIG. 3, to the lower bypass position shown in FIG. 4.

Although not required to all embodiments, as shown in FIGS. 5 and 6, the illustrated embodiment includes a biasing mechanism 80 configured to bias the sliding supports toward a predetermined position. Biasing mechanism 80 is shown to include a biasing member 82, in the form of an elastic band, looped over an upper tab 84 extending from the rear surface of the top portion of one of upright supports 54, and a lower tab 86 extending from back member 62. Although not shown, the other upright support may be similarly configured. In the illustrated embodiment, biasing mechanism 80 is configured to urge the first jump assembly toward the first bypass position.

Thus, although biasing mechanisms in other embodiments may bias movable components to other positions than as shown, the biasing mechanism of the illustrated may result in simple, one-handed operation of the intersection assembly 30, for example by allowing a user to move the first jump assembly to a desired position simply by pressing downward on the handle, as indicated by arrows C in FIGS. 3, 4, and 6. One-handed operation of the intersection assembly may allow a user to determine whether or when to introduce additional toy vehicles to the track while operating the handle with one hand, such as by selectively feeding toy vehicles through the booster 22 with the other hand.

Thus, when multiple vehicles are simultaneously traversing the track, by using the handle, a user may move or hold the first jump assembly to, or in, a desired position, for example to collide toy vehicles or allow them to traverse the intersection without colliding. Additionally, the biasing structure, in coordination with the continuously translatable range of movement of the sliding supports relative to the upright supports, may allow the user to quickly revert the first jump assembly to the upper bypass position simply by releasing the handle. Depending on the hand-eye coordination of the user, this may present an additional level of challenge in causing or avoiding a collision, and/or may allow a user to impart additional upward force to a toy vehicle being launched from the ramp portion of the first jump assembly as it is being moved quickly upward.

The various components of the illustrated toy vehicle track sets, and its various components and accessories, if present, may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, or the like. Suitable foamed plastics may include expanded or extruded polystyrene, or the like.

The exemplary embodiments and methods illustrated and disclosed herein are believed to encompass multiple distinct inventions with independent utility. While each has been disclosed in an exemplary form, the specific embodiments thereof as disclosed and illustrated herein are not to be considered in a limiting sense as numerous variations of the concepts and components are possible. The subject matter of the inventions includes all novel and non-obvious combinations and subcombinations of the various elements, features, functions and/or properties disclosed herein. Similarly, where any description recites "a" or "a first" element or the equivalent thereof, such description should be understood to include incorporation of one or more such elements, neither requiring nor excluding two or more such elements.

We claim:

1. An intersection apparatus for use with a toy vehicle track for toy vehicles, the apparatus comprising:

a ramp portion and a corresponding receiving portion spaced to form a gap therebetween, and defining a first toy vehicle pathway from the ramp portion to the receiving portion across the gap;

a second toy vehicle pathway that crosses the first toy vehicle pathway;

wherein the first ramp portion is translatable in a direction transverse to the first and second toy vehicle pathways between a bypass position in which the trajectory of a first toy vehicle traversing the first toy vehicle pathway passes and does not intersect the trajectory of a second toy vehicle traversing the second toy vehicle pathway, and an intersect position in which the trajectory of the first toy vehicle traversing the first toy vehicle pathway intersects the trajectory of a toy vehicle traversing the second toy vehicle pathway, such that when the ramp portion is in the intersect position, the first and second toy vehicles traversing the first and second toy vehicle pathways at substantially the same time will collide; and wherein the bypass position is a first bypass position, in which the trajectory of the first toy vehicle traversing the first toy vehicle pathway passes on one side of the trajectory of the second toy vehicle traversing the second toy vehicle pathway, and wherein the ramp portion is further translatable to a second bypass position, in which the trajectory of the first toy vehicle traversing the first toy vehicle pathway passes on the opposite side of and does not intersect the trajectory of the second toy vehicle traversing the second toy vehicle pathway.

2. The intersection apparatus of claim 1 wherein the second toy vehicle pathway consists of a flat portion of track.

3. The intersection apparatus of claim 1 wherein in the intersect position, the ramp portion is disposed so that the trajectory of the first toy vehicle traversing the first toy vehicle pathway partially overlaps the trajectory of the second toy vehicle traversing the second toy vehicle pathway, such that when the ramp portion is in the intersect position, a lower portion of the first toy vehicle traversing the first toy vehicle pathway at substantially the same time as the second toy vehicle traversing the second toy vehicle pathway will collide with an upper portion of the second toy vehicle.

4. The intersection apparatus of claim 1, wherein the ramp portion and receiving portion are operatively coupled such that translating the ramp portion correspondingly translates the receiving portion.

5. The intersection apparatus of claim 1, wherein the ramp portion and the receiving portion defining the first toy vehicle pathway are a first ramp portion and a first receiving portion, and wherein the second toy vehicle pathway is defined by a second ramp portion and a second receiving portion that are also spaced from each other to form a gap therebetween.

6. The intersection apparatus of claim 5, wherein the gap formed between the first ramp and receiving portions overlaps the gap formed between the second ramp and receiving portions.

7. The intersection apparatus of claim 1, wherein when the first ramp portion is in a first of the two bypass positions, the trajectory of the first toy vehicle traversing the first toy vehicle pathway passes above the trajectory of the second toy vehicle traversing the second toy vehicle pathway, and wherein when the first ramp portion is in a second of the two bypass positions, the trajectory of the first toy vehicle traversing the first toy vehicle pathway passes below the trajectory of the second toy vehicle traversing the second toy vehicle pathway.

8. The intersection apparatus of claim 1, wherein the first ramp portion is biased toward the first of the two bypass positions.

9. An intersection apparatus for use with a toy vehicle track for toy vehicles, the apparatus comprising:

a base;

a framework extending from the base;

a first jump assembly movably supported on the framework;

a second jump assembly supported on the base;

wherein each jump assembly includes a ramp portion adapted to launch a toy vehicle toward a corresponding receiving portion that is spaced therefrom, such that the jump assemblies thereby define first and second toy vehicle trajectories, respectively, and are disposed such that the first and second toy vehicle trajectories defined thereby cross each other; and wherein the first jump assembly is movable between a first position, in which the first toy vehicle trajectory passes above the second toy vehicle trajectory, and a second position, in which the first toy vehicle trajectory passes beneath the second toy vehicle trajectory, through an intermediate position in which the first and second toy vehicle trajectories intersect; and wherein the framework includes a pair of upright supports and a corresponding pair of sliding portions, each sliding portion movably coupled to one of the upright supports, and wherein the ramp portion and receiving portion of the first jump assembly are each mounted to one of the sliding portion.

10. The intersection apparatus of claim 9, wherein the sliding portions are coupled for cooperative movement.

11. The intersection apparatus of claim 10, wherein the framework further includes a cross-piece coupling the sliding portions.

12. The intersection apparatus of claim 11, wherein the intersection apparatus further includes a handle extending from the cross-piece, and wherein the handle is operable to move the first jump assembly between the first and second positions.

13. The intersection apparatus of claim 9, wherein the framework includes a biasing mechanism configured to urge the second jump assembly toward the first position.

14. The intersection apparatus of claim 13, wherein at least one of the sliding portions is configured to move relative to the corresponding upright support in a range of movement between an upper position that corresponds to the first position of the first jump assembly and a lower position that corresponds to the second position of the first jump assembly, and wherein the biasing mechanism includes a biasing member configured to urge the at least one of the sliding portions toward the upper position.

15. The intersection apparatus of claim 9, wherein the second jump assembly is movable along a substantially vertical axis.

16. The intersection apparatus of claim 9, wherein when the second jump assembly portion is in the intermediate position, toy vehicles traversing the first and second jump assemblies at substantially the same time will collide.

17. A toy vehicle playset, comprising:

a toy vehicle track arranged to define at least one pathway for one or more toy vehicles to traverse, and including at least one intersection in which a section of pathway crosses another section of pathway;

an intersection apparatus positioned at the intersection and including first and second jump assemblies each configured to launch a first toy vehicle from a ramp portion and across a gap to a receiving portion, respectively, wherein the ramp and receiving portions are disposed such that the first toy vehicle traverses the intersection by jumping the gap of either the first or second jump assemblies;

wherein at least one of the first and second jump assemblies is movable relative to the other between an upper position in which the first toy vehicle jumping the gap of the first jump assembly will pass over a second toy vehicle simultaneously jumping the gap of the second jump assembly, and a lower position in which the first toy vehicle jumping the gap of the first jump assembly will pass beneath the second toy vehicle simultaneously jumping the gap of the second jump assembly, through an intermediate position in which the first toy vehicle jumping the gap of the first jump assembly will collide with the second toy vehicle simultaneously jumping the gap of the second jump assembly.

* * * * *